United States Patent [19]

Sheriff

[11] Patent Number: 4,751,514

[45] Date of Patent: Jun. 14, 1988

[54] MULTI-FREQUENCY VEHICULAR ANTENNA SYSTEM

[75] Inventor: Jack W. Sheriff, La Jolla, Calif.

[73] Assignee: Modublox & Co., Inc., La Jolla, Calif.

[21] Appl. No.: 848,519

[22] Filed: Apr. 7, 1986

[51] Int. Cl.[4] ..... H01Q 1/32

[52] U.S. Cl. ..... 343/717; 343/713

[58] Field of Search ..... 343/717, 713, 711, 712, 343/790, 791

[56] References Cited

U.S. PATENT DOCUMENTS

| | | | |
|---|---|---|---|
| 1,792,193 | 2/1931 | Stewart | 343/717 |
| 3,646,561 | 2/1972 | Clarke | 343/713 |
| 3,717,876 | 2/1973 | Volkers | 343/712 |
| 3,916,413 | 10/1975 | Davis | 343/712 |
| 3,961,330 | 6/1976 | Davis | 343/712 |
| 4,117,490 | 9/1978 | Arnold | 343/708 |
| 4,160,977 | 7/1979 | Davis | 343/711 |
| 4,317,121 | 2/1982 | Allen, Jr. et al. | 343/712 |
| 4,331,961 | 5/1982 | Davis | 343/713 |

*Primary Examiner*—William L. Sikes
*Assistant Examiner*—Hoanganh Le
*Attorney, Agent, or Firm*—Charmasson & Holz

[57] ABSTRACT

An antenna system which operates over a wide spectrum of radio frequencies by utilizing a body of a vehicle as an antenna. The antenna system comprises a tuned impedance-matching coupler and a uniquely-configured floating, low-capacitance coaxial transmission line. In this arrangement, the outer conductor of the transmission line connecting the coupler to the vehicular body is severed at both ends. Thus, electrical connection between the coupler and the vehicle body is provided only by the transmission line's center conductor and the line's capacitive coupling. Antenna performance with the instant configuration exhibits improved voltage standing wave ratios and field strength as compared to conventional radio antennas.

14 Claims, 1 Drawing Sheet

FIG.1A
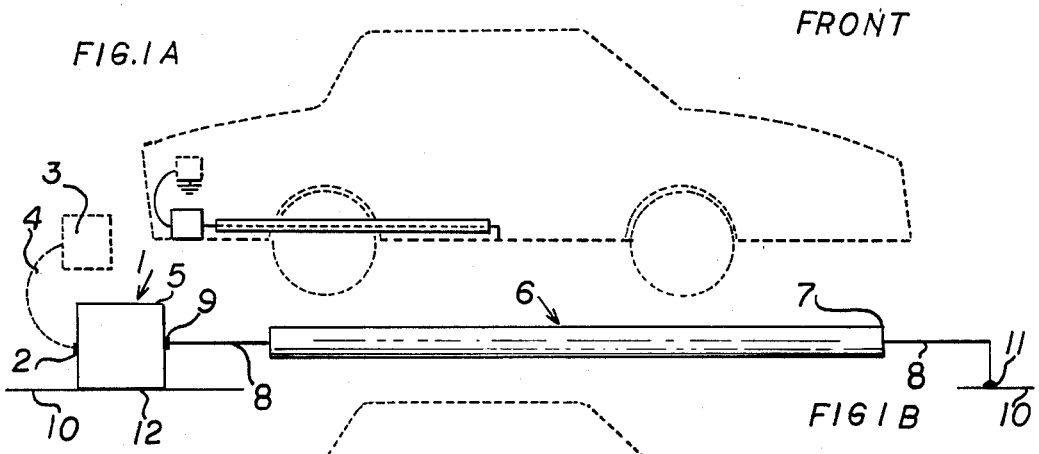
FIG 1B
FIG.2A
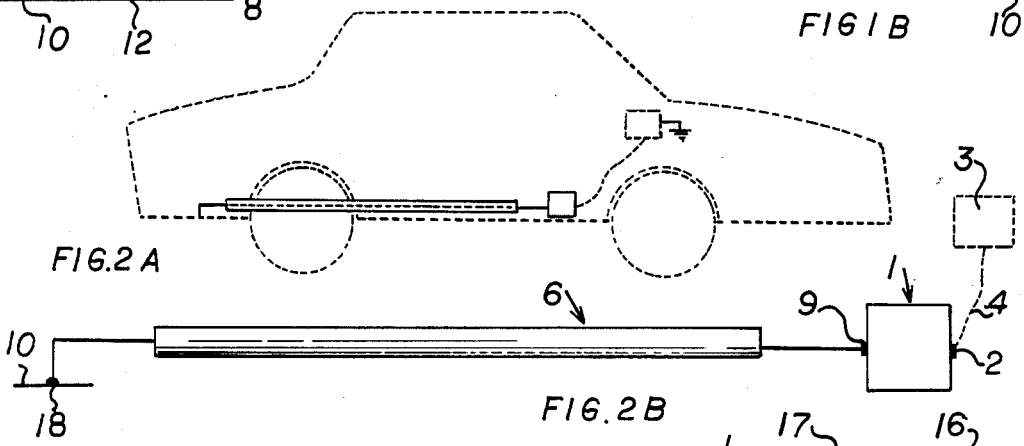
FIG.2B
FIG.5
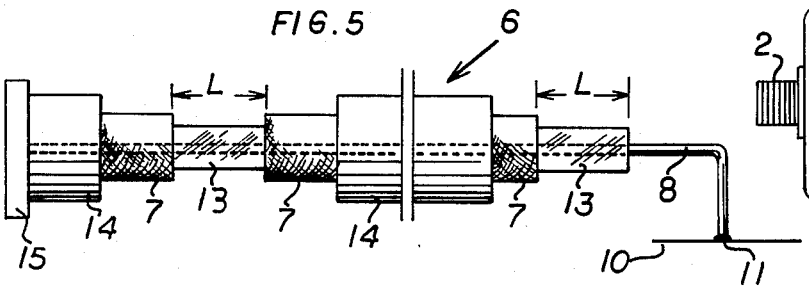
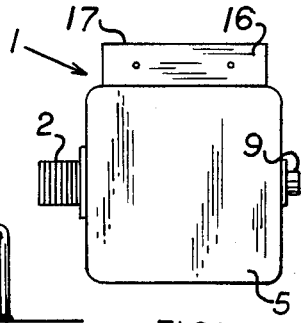
FIG.3
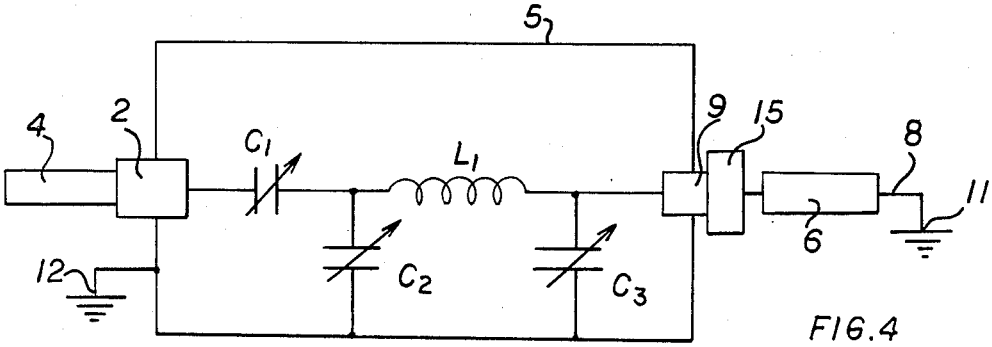
FIG.4

MULTI-FREQUENCY VEHICULAR ANTENNA SYSTEM

FIELD OF THE INVENTION

The present invention relates to an antenna system, and more particularly, to a multi-frequency vehicular antenna.

BACKGROUND OF THE INVENTION

Previous attempts to incorporate the body of a vehicle as an antenna have proven ineffective. Because of the unusual characteristics and difficult problems encountered in extracting usable radio frequency (RF) signals from such conductive structures, the state of the art has developed slowly.

A number of patents have been issued in this field, but none of the techniques taught in the prior art are similar to those disclosed in the present invention, nor have the earlier inventions worked well in practice.

U.S. Pat. No. 3,717,876 to Volkers, "Ferrite Antenna Coupled to Radio Frequency Currents in Vehicle Body," describes a cascade arrangement wherein a Faraday cage acts as the primary antenna, which intercepts the electromagnetic waves and reradiates them to a secondary antenna with in the Faraday cage. In one of such arrangements, the body of an automobile is used as the Faraday cage while a ferrite antenna is used as the secondary antenna.

U.S. Pat. No. 3,916,413 to Davis, "Remotely Tuned Conductive-Boay Antenna system," discloses a voltage and impedance transformer applied to increase the inductive reactive of coupling to the vehicle body. Such coupling is achieved by using the magnetic signal from the fine wire antenna in the windshield/window or a whip antenna on most automobiles.

U.S. Pat. No. 3,961,330 to Davis, "Antenna System Utilizing Currents in Conductive Body," an improvement over the aforementioned antenna system to the same inventor, includes coupling at locations such as a vertical column of the vehicle where the conductive body has reduced cross section.

U.S. Pat. No. 4,100,546 to Campbell, "Airborne Antenna System Employing the Airframe As An Antenna," teaches a phase front homing system airborne antenna array employing portions or the vertical landing gear struts as antenna elements. This system obtains the desired homing direction by measuring the phase difference between signals picked up by the two antenna elements.

Finally, U.S. Pat. No. 4,117,490 to Arold et al, "Inconspicuous Antenna System Employing the Airframe As An Antenna," also discloses a phase front homing system airborne antenna array application, which is improved by inclusion of discrete axial coupling sleeves in the landing struts.

The inventor is unaware of applications utilizing the novel arrangements more fully described below, nor applications wherein the above-described prior art has been successfully implemented. Inventor's empirical data, on the other hand, demonstrate the efficacy of the instant invention.

SUMMARY OF THE INVENTION

It is an object of the present invention to provide a vehicular antenna system whose elements are concealed or inconspicuous.

Another object of the instant invention is to provide a vehicular antenna system that is relatively simple in construction and configuration, thus minimizing manufacturing, installation and maintenance costs.

A further object of this invention is to provide a multi-frequency system that efficiently and optimally operates over a broad spectrum of radio frequencies.

Heretofore approaches utilizing the body of a vehicle as a radiating element have focused on the application of center-fed loading of various kinds. These applications have not been successful because such conductive bodies have a low radiation resistance and high inductive reactance.

Although operating a vehicle as an end-fed dipole would be preferable in theory because such a system's RF radiation resistance would be materially raised by a factor of at least fifty as compared to a center-fed configuration, the inventor has determined that a center-fed loading point provides optimal performance. That is, connecting the telecommunication device such as a transmitter, receiver or a transceiver to the vehicle at a central location minimizes the inductive reactance and high capacitance to ground. This arrangement, however, is complicated by the distributed capacitance of any transmission line installed on the vehicle which causes RF losses by capacitance coupling.

The above-described problem is resolved by utilizing a heretofore unused property of the transmission line--its capacitance.

In sum, the instant vehicular antenna system uniquely creates an impedance match to the body of the vehicle. The impedance match is achieved by a novel configuration utilizing a low-capacitance coaxial transmission line. Here, the outer conductor or the transmission line is floated; therefore, only its capacitive effect and the center conductor are electrically connected in the antenna system. The advantages of this arrangement are exhibited by low voltage standing wave ratios (VSWRs) and high field strength measurements over a broad range of radio frequencies, which are superior to those attained by conventional antennas.

The present invention has been reduced to practice over a wide range of frequencies-the mobile band, 26.175–27.500 MHz, more popularly known as the citizens' band (CB); the FM commercial broadcast band, 88–108 MHz; and the amateur radio band, 220–224 MHz. In general terms, these frequency ranges encompass the radio frequencies commonly known as the lower VHF band, the upper VHF band, and the UHF band.

The features of the invention believed to be novel are set forth with particularity in the appended claims. The invention itself, however, both as to organization and method of operation, together with further objects and advantages thereof, may be best understood by reference to the following description taken in conjunction with the accompanying drawings.

Other objects and advantages of the invention will be apparent from the following description and the accompanying drawings which are for the purpose of illustration only.

BRIEF DESCRIPTION OF THE DRAWINGS

FIG. 1A is a block diagram of one embodiment of a vehicular antenna system according to the present invention which operates in the lower VHF band;

FIG. 1B is an enlargement showing the details of FIG. 1A;

FIG. 2A is a block diagram of a second embodiment of the vehicular antenna system according to the present invention which operates in the upper VHF and UHF bands;

FIG. 2B is an enlargement showing the details of FIG. 2A;

FIG. 3 is a side elevation view of the vehicular antenna coupler;

FIG. 4 is a schematic diagram of the vehicular antenna coupler showing a combination Pi and Gamma impedance-matching network; and FIG. 5 is a detailed elevation view of a typical coaxial transmission line showing the floating outer conductor configuration.

DESCRIPTION OF THE PREFERRED EMBODIMENTS OF THE INVENTION

The present invention relates to a uniquely-configured multi-frequency vehicular antenna system which utilizes the surface or outer metallic skin of a vehicle as an antenna. Because the principles of the present invention are equally advantageous over a wide range of frequencies and a variety of vehicles, it is not the inventor's intent to limit the principles of the present invention to the specific embodiments illustrated below.

The instant antenna system has numerous applications. A particular application in the CB band concerns vehicular security alarm systems. Such systems have proven quite popular in recent years due to increased concern by the general public for crime prevention. The following description of the claimed invention concerns this particular application.

An automobile is approximateley fifteen feet long. Thus, at 27 MHz, a commonly used CB frequency, the automobile's length is about one-half wavelength. As a radiating element such a vehicle is ineffective, however, because it operates as a dipole very low to the ground, having small ratio of wavelength to diameter and an inductive load. Its radiation resistance is about ten ohms (real component) with a high reactive component which must be tuned out to achieve optimum radiation performance.

FIG. 1A is a block diagram of a first embodiment of the instant vehicular antenna system for CB applications (27 MHz). This drawing shows a typical arrangement of the antenna system while FIG. 1B is a detailed enlargement showing the individual elements. The antenna system is comprised of an impedance-matching coupler 1, represented schematically in FIG. 4, which is connected at its input connector 2 to a telecommunication device 3 via a transmission line 4. The coupler 1 is enclosed in an electrically conductive housing 5. The antenna system also includes a second coaxial transmission line 6, basically comprised of an outer conductor 7 and a center conductor 8.

Further describing FIGS. 1A and 1B, transmission line 6 connecting coupler 1 to the vehicle is attached to coupler 1 at an output connector 9. The other end of transmission line 6 is attached to body 10 of the vehicle at a central location 11. When connecting the transmission line 6 to the vehicle body 10 it is preferable to attach the line to the outer surface or skin of the vehicle instead of its chassis. Although connection can be made to the chassis or other parts of the vehicle frame, for example when the outer skin of the vehicle is non-conductive, this is not recommended because rusting commonly occurs along these areas and will cause the vehicle's electrical resistance, and hence the antenna's radiation performance, to change. The coupler 1 is grounded at the rear of the vehicle at a location 12 along the body 10 which is as far away as practicable from the vehicle's center 11.

The aforementioned individual elements are simple, but the manner in which these elements are configured makes the instant system unique. The claimed arrangement minimizes the distributive capacitance due to transmission line 6 over its entire length from output connector 9 to the central point 11 on the vehicle. This novel configuration is achieved by floating the transmission line 6, which has a low capacitance per unit length.

A typical low-capacitance transmission line 6 is illustrated in FIG. 5. The cable includes an outer conductor or braided shield 7 (the "braid"), a center conductor 8, a polyurethane or other dielectric core 13, and a jacket 14.

As detailed in FIGS. 1B and 5, the transmission line's outer conductor 7 at each end of the line 6 is intentionally severed and is left mechanically unconnected to the rest of the antenna system. This is accomplished by cutting out a section of the braid 7 from low-capacitance RG-62 coaxial cable approximately a quarter inch at each end thereof; thus, leaving a gap, L, at both ends of the transmission line 6. One gap is located at the rear of the vehicle where transmission line 6 connects to the coupler's output connector 9 via a mating connector 15, and a second gap is positioned near the central point 11 on the surface 10 of the vehicle.

In practice, one method of connecting transmission line 6 to the central point 11 on the vehicle is by placing conductor 8 in a hole drilled under the door of the vehicle and securing conductor 8 to the surface with a sheet metal screw or other suitable fastener. Thus, metal-to-metal contact provides firm electrical contact between the transmission line and the vehicle. The line 6 is then placed under the floor mat and laid to a rearward location 12, typically the trunk or the vehicle, where the coupler 1 is connected to the vehicle body 10.

Thus, the coaxial transmission line 6 simply acts electrically as a capacitor and effectively appears to the coupler 1 as an additional element of series capacitance. That is, such series capacitance is comprised of a first capacitance from braid 7 to the vehicle at the central point 11, and a second capacitance from braid 7 to the center conductor 8. If the instant arrangement is not utilized, on the other hand, the shunt capacitance of transmission line 6 will dissipate RF energy from the radiation resistance and suboptimal antenna radiation performance will be obtained.

FIG. 3 shows a detailed side elevation view of one embodiment of the vehicular antenna coupler 1. The housing 5 encloses the impedance-matching network, FIG. 4, with input connector 2 and output connector 9 situated on opposite sides of the housing 5. Both connectors 2, 9 utilize a conventional coaxial arrangement with a center feed conductor (not shown) and an outer ground conductor (not shown).

Further describing FIG. 3, a rear wall (not shown) of housing 5 is attached to a plate 16. The plate 16 provides a slotted edge 17 to facilitate connection of the housing 5 to the surface 10.

Turning now to the schematic diagram of FIG. 4, the inventor has determined that the vehicle's low impedance can be matched by utilizing a tuned coupler equipped with a combination of conventional impedance-matching networks.

While either a Pi or Gamma-type network, alone, results in VSWRs of about 1.30, the combination of such networks represented in the schematic diagram achieve near-perfect coupling.

As shown in FIG. 4, capacitor $C_1$ provides an additional division to the Pi network comprised of inductor $L_1$ and capacitors $C_2$ and $C_3$, allowing $C_1$ to match very low RF radiation resistances, such as that provided by the vehicle. The Pi network meanwhile effectively tunes out the vehicle's inductance and thus provides a proper match to the antenna system. Capacitor $C_3$ is equal to the sum of the capacitances from the center conductor 8 to the braid 7 and that from the braid 7 to the vehicle frame at the connection point 11. This arrangement, therefore, matches the respective capacitive elements, the low radiation resistance, and the high inductance of the vehicle.

The capacitors are adjusted for minimum VSWR by using a conventional VSWR bridge in line with the circuit. When the coupler 1 is installed with the housing 5 connected at the rearward location 12 of the vehicle, and the coaxial cable is dressed to the outer skin of the vehicle, a VSWR of 1.10 is readily achieved.

The above-described embodiment, as expected, operates similarly to a dipole operating very close to ground. Its performance characteristics in the CB band, however, are superior to those obtained by conventional 36-inch whip antennas commonly in use, either with or without loading coils.

The radiation generated from the instant antenna system is horizontal in polarity with some vertical components. Compared to the opration of the 36-inch whip antenna, the field strength of such arrangement is increased several times and has a very high angle of radiation. In fact, it is nearly isotropic. This is advantageous for alarm systems in that the antenna's radiation can penetrate many more floors in an apartment building than the whip antenna, which has a null at the vertical elevation of its radiation pattern. Full penetration in reinforced concrete building up to 14 floors high has been observed with a vehicle parked in the basement. This is more than three times the number of floors penetrated by the 36-inch whip antenna.

Tests have also been conducted using an alarm system at 27.04 MHz and data indicate that suitable antenna performance is achieved at distances of 2–3 miles in rolling terrain and 3–4 miles in flat terrain.

Finally, conventional vehicular security alarm systems currently marketed typically utilize a vehicle's external radio antenna or an auxiliary equivalent which allows the alarm system to operate with retractable antennas. The instant invention, however, utilizes the entire vehicle as the antenna and keeps all of its components concealed. Therefore, the instant invention prevents a would-be thief from conveniently removing the antenna and rendering the alarm system inoperable.

A second embodiment of the present invention which operates in the upper VHF and UHF bands is shown in FIGS. 2A and 2B. More particularly, the following discussion describes an application at broadcast FM frequencies. At the midpoint of the FM band, 98 MHz, a vehicle is about 1.5 wavelengths long. The vehicle's telecommunication device 3 is typically in a fixed location approximateley five feet behind the front of the vehicle. In this configuration, the coupler 1 is positioned adjacent to the device 3 and connected to it via transmission line 4. Here, inductor $L_1$ is modified to resonate in the FM band and requires five turns as compared to the 18-turn inductor for CB applications. As in the CB application, the transmission line's outer conductor 7 is floating and the center conductor 8 is connected at a rearward point 18 on the vehicle surface 10.

In this arrangement, the inventor has also achieved excellent antenna performance. Since it is desirable to cover the entire FM band from 88 to 108 MHz, tuning the coupler 1 to the frequency 95 MHz achieves optimum performance. Therefore, at any frequency across the FM band a maximum VSWR of 2.20 is achieved. Such operation is adequate for reception purposes.

Utilizing the vehicle as an antenna in this frequency band has major advantages over conventional antennas. First, the entire surface of the vehicle effectively integrates FM signals received directly by line-of-sight from the FM radio station, by reflections from buildings, and by reflections from the inversion layer in the atmosphere. Thus, little if any multipath distortion and picket-fencing commonly found with FM reception in vehicles using conventional vertical antennas has been observed in the instant case.

Second, radiation performance of the instant antenna system operating at FM is superior to that of conventional systems. Although FM signals are vertically polarized in the near electrical field and better reception is provided with a 36-inch whip in this range as compared to the horizontal or elliptical polarization in the present invention, empirical data indicate that antenna performance with the claimed invention in the far electrical field regions, where reflections occur, is superior. Such improved performance in the far field is attributable to its elliptical and integrating features.

In FIG. 2B, transmission line 6 is dimensioned to be five feet or preferably ten feet in length. At ten feet, the transmission line 6 represents about one wavelength in the FM band. Again, low-capacitance RG-62 coaxial cable can be utilized.

The present invention has also operated successfully at broadcast frequencies higher than the two embodiments just described. Tests have been conducted by using the vehicular antenna system in the two-meter amateur band (144–148 MHz) with satisfactory performance. Again, the integrating features of this novel system provided significant advantages over the performance of a conventional vertical whip in the far field.

Further, test data indicate that satisfactory performance is achieved in the amateur band (220–224 MHz). The instant antenna system, therefore, can be operated at 150–160 MHz for police work where excellent communication long distances from the station can be obtained without the use of an external conventional antenna.

While the embodiments of this invention operate in the CB, FM and amateur radio bands, the instant antenna system employing the general principles discussed can similarly operate in other radio frequency bands through the VHF and UHF range.

Thus, modification to the preferred embodiments of the invention can be made and other embodiments may be devised with in the spirit of the invention and the scope of the appended claims.

What is claimed is:

1.In combination with a vehicle having an electrically conductive body, an antenna for a telecommunication device which comprises:

a length of conductive wire having one end electrically connected to said body, said length being determined by the frequency range of the telecommunication device;

a floating electrostatic and electromagnetic shield insulated from said body and surrounding said length of wire, said floating electrostatic and electromagnetic shield and said conductive wire being dielectrically insulated from each other to maintain a low capacitive reactance between said conductive wire and said vehicle body at the operating frequency of said telecommunication device, said low capacitive reactance allowing a low voltage standing wave ratio;

an impedance coupling means having a bipolar input terminal and a single output terminal, said output terminal being connected to the other end of said length of wire;

cover means in electrical contact with said body for electromagnetically shielding said coupling means; and conductor means for connecting said bipolar input terminal to the antenna terminal of the telecommunication device.

2. The antenna of claim 1 operating in the lower VHF band wherein said one end of conductive wire is connected to a substantially central point on said vehicle body.

3. The antenna of claim 2 wherein said impedance coupling means comprises a combination Pi and Gamma network.

4. The antenna of claim 3 wherein said impedance coupling means includes means for adjustably tuning the combination Pi and Gamma network.

5. The antenna of claim 2 wherein said conductive wire and said floating electrostatic and electromagnetic shied are made from a length of coaxial transmission line.

6. The antenna of claim 2 wherein said electrically conductive body is the metallic outer skin of the vehicle.

7. The antenna of claim 2 wherein said electrically conductive body is the chassis of the vehicle.

8. The antenna of claim 1 operating in the upper VHF and UHF bands wherein said length of the conductive wire is dimensioned electrically to be a substantial portion of one wavelength at the frequency being utilized.

9. The antenna of claim 8 wherein said one end or conductive wire is connected to a point laterally spaced apart from the substantially central point on said vehicle body.

10. The antenna of claim 9 wherein said impedance coupling means comprises a combination Pi and Gamma network.

11. The antenna of claim 10 wherein said impedance coupling means includes means for adjustably tuning the combination Pi and Gamma network.

12. The antenna of claim 9 wherein said conductive wire and said floating electromagnetic shield are made from a length of coaxial transmission line.

13. The antnna of claim 9 wherein said electrically conductive body is the metallic outer skin of the vehicle.

14. The antenna of claim 9 wherein said electrically conductive body is the chassis of the vehicle.

* * * * *